US010498048B2

(12) United States Patent
Washio et al.

(10) Patent No.: US 10,498,048 B2
(45) Date of Patent: Dec. 3, 2019

(54) WIRE WITH TERMINAL HAVING A CORE CRIMPING PORTION WITH ENLARGED DIAMETER PORTION AND A RECESS IN THE ENLARGED DIAMETER PORTION

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuhiro Washio, Mie (JP); Kenji Miyamoto, Mie (JP); Taiji Mochizuki, Mie (JP); Naoya Nishimura, Mie (JP); Takanobu Shimada, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/032,216

(22) Filed: Jul. 11, 2018

(65) Prior Publication Data

US 2019/0044252 A1 Feb. 7, 2019

(30) Foreign Application Priority Data

Aug. 1, 2017 (JP) ..... 2017-149282

(51) Int. Cl.

| | |
|---|---|
| ***H01R 4/18*** | (2006.01) |
| ***H01R 43/048*** | (2006.01) |
| ***H01R 43/16*** | (2006.01) |
| ***H01R 4/70*** | (2006.01) |
| *H01R 4/62* | (2006.01) |

(52) U.S. Cl.

CPC ..... *H01R 4/185* (2013.01); *H01R 4/188* (2013.01); *H01R 4/70* (2013.01); *H01R 43/048* (2013.01); *H01R 43/16* (2013.01); *H01R 4/62* (2013.01); *H01R 43/0486* (2013.01)

(58) Field of Classification Search

CPC ..... H01R 4/185; H01R 4/62
USPC ..... 439/877, 878
See application file for complete search history.

(56) References Cited

U.S. PATENT DOCUMENTS 3,355,698 A * 11/1967 Keller ..... H01R 4/10 439/421
3,735,331 A * 5/1973 O'Donnell ..... H01R 4/2495 439/421
3,953,103 A * 4/1976 Mathis ..... H01R 4/185 439/866

(Continued)

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A wire with terminal (10) includes at least one wire (11) having a core (13) and a terminal (12) connected to the wire (11). The terminal (12) includes a wire barrel (16) to be caulked and crimped to the core (13). At least one end part of the wire barrel (16) in an extension direction of the wire (11) is provided with an enlarged diameter portion (20) enlarged in diameter toward the one end part. At least one recess (24E) is provided at a position corresponding to the enlarged diameter portion (20) and in a region configured to come into contact with the core (13) in a placing surface (23) of the wire barrel (16) where the core (13) is arranged.

6 Claims, 15 Drawing Sheets

(56) References Cited

U.S. PATENT DOCUMENTS 3,955,044 A * 5/1976 Hoffman ..... H01R 4/203 174/84 C
5,422,438 A * 6/1995 Lamome ..... H01R 4/203 174/76
6,749,457 B2 * 6/2004 Sakaguchi ..... H01R 4/185 439/421
7,210,858 B2 * 5/2007 Sago ..... G02B 6/3807 385/88
7,306,495 B2 * 12/2007 Hashimoto ..... H01R 4/185 439/877
7,438,609 B2 * 10/2008 Yagi ..... H01R 4/184 439/741
7,722,416 B2 * 5/2010 Gump ..... H01R 4/188 439/879
7,905,745 B2 * 3/2011 Watanabe ..... H01R 4/62 439/442
7,931,510 B2 * 4/2011 Fukase ..... H01R 4/185 439/442
8,070,536 B2 * 12/2011 Ono ..... H01R 4/185 439/877
8,177,591 B2 * 5/2012 Okamura ..... H01R 4/188 439/877
8,210,884 B2 * 7/2012 Corman ..... H01R 4/185 439/877
8,221,171 B2 * 7/2012 Ono ..... H01R 4/185 439/877
8,342,894 B2 * 1/2013 Uchiyama ..... H01R 43/048 439/882
8,485,853 B2 * 7/2013 Seifert ..... H01R 4/188 439/882
8,622,774 B2 * 1/2014 Seifert ..... H01R 4/185 439/882
8,622,775 B2 * 1/2014 Takashima ..... H01R 4/024 439/886
8,870,611 B2 * 10/2014 Sato ..... H01R 4/188 439/877
8,905,799 B2 * 12/2014 Endo ..... H01R 4/185 439/442
8,974,258 B2 * 3/2015 Mitose ..... H01R 4/184 439/877
9,039,467 B2 * 5/2015 Seipel ..... H01R 4/185 439/877
9,048,550 B2 * 6/2015 Onuma ..... H01R 4/188
9,054,431 B2 * 6/2015 Endo ..... H01R 4/185
9,065,190 B2 * 6/2015 Kuwayama ..... H01R 4/188
9,099,794 B2 * 8/2015 Ito ..... H01R 4/188
9,130,284 B2 * 9/2015 Onuma ..... H01R 4/185
9,147,944 B2 * 9/2015 Aizawa ..... H01R 4/185
9,147,945 B2 * 9/2015 Sato ..... H01R 4/188
9,252,527 B2 * 2/2016 Aizawa ..... H01R 4/72
9,437,938 B2 * 9/2016 Ohnuma ..... H01R 4/185
9,502,784 B2 * 11/2016 Ohnuma ..... H01R 4/62
9,502,785 B2 * 11/2016 Schmidt ..... H01R 4/183
9,640,877 B2 * 5/2017 Aoki ..... H01R 4/185
9,853,368 B2 * 12/2017 Myer ..... H01R 4/185
2010/0105257 A1 * 4/2010 Kumakura ..... H01R 4/185 439/877
2010/0248559 A1 * 9/2010 Fukase ..... H01R 4/185 439/878
2014/0004758 A1 * 1/2014 Kondou ..... H01R 4/188 439/877
2015/0050838 A1 * 2/2015 Copper ..... H01R 13/114 439/626
2015/0357722 A1 * 12/2015 Sato ..... H01R 13/5216 439/877
2015/0380834 A1 * 12/2015 Seipel ..... H01R 4/182 439/877
2016/0172769 A1 * 6/2016 Kamoshida ..... H01R 4/62 439/877
2016/0352033 A1 * 12/2016 Sachs ..... H01R 4/188
2017/0005417 A1 * 1/2017 Aoki ..... H01R 4/62
2017/0162954 A1 * 6/2017 Nickel ..... H01R 4/184
2017/0179617 A1 * 6/2017 Yoshida ..... H01R 4/185
2017/0179618 A1 * 6/2017 Yoshida ..... H01R 4/185
2017/0179619 A1 * 6/2017 Nakata ..... H01R 4/185
2017/0179620 A1 * 6/2017 Shinohara ..... H01R 4/185
2017/0324172 A1 * 11/2017 Myer ..... H01R 4/185
2018/0294612 A1 * 10/2018 Shimada ..... H01B 13/00

* cited by examiner

WIRE WITH TERMINAL HAVING A CORE CRIMPING PORTION WITH ENLARGED DIAMETER PORTION AND A RECESS IN THE ENLARGED DIAMETER PORTION

BACKGROUND

Field of the Invention

This specification relates to a wire connected with a terminal.

Description of the Related Art

US Patent Application Publication No. 2010/0248559 discloses a terminal fitting with a crimping portion that is crimped to a core exposed from a wire. The crimping portion is formed with a bell-mouth expanded out toward an end part. An outward expanding angle of this bell-mouth is larger than an expanding angle of a thin part of the wire with respect to an extending direction of the core. This causes a crimped state of the core to change gently so that a fixing force between the wire core and the terminal fitting increases. However, this configuration does not always increase the fixing force between the wire core and the terminal sufficiently.

The structure disclosed in this specification was completed on the basis of the above situation and aims to improve a fixing force between a wire and a terminal.

SUMMARY

This specification is directed to a wire with a terminal. The wire includes a core, and the terminal is connected to the wire. The terminal includes a core crimping portion to be caulked and crimped to the core. At least one end part of the core crimping portion in an extension direction of the wire is provided with an enlarged diameter portion that is enlarged in diameter toward the one end part, and at least one recess is provided at a position corresponding to the enlarged diameter portion. The recess is in a region that will contact the core in a placing surface of the core crimping portion where the core is arranged. According to this configuration, the enlarged diameter portion of the core crimping portion crimps the core in a low compression state. A fixing force between the core crimping portion and the core is relatively large in a region where the core is in the low compression state. The core is inserted into the recess in this low compression state, and the core inserted in the recess is anchored to improve a fixing force between the core crimping portion of the terminal and the core. As a result, a fixing force between the terminal and the wire can be improved.

A compression ratio of the core is a percentage of a cross-sectional area when a region surrounded by the placing surface of the core crimping portion is cut along a plane perpendicular to the extension direction to a cross-sectional area of the core before the core crimping portion is crimped. In accordance with one embodiment, a compression ratio at an innermost position of the enlarged diameter portion in the extension direction is 50% to 80%, and a compression ratio at an outermost position of the enlarged diameter portion in the extension direction is 80% to 110%. According to this configuration, electrical connection reliability between the core and the core crimping portion can be improved at least at the innermost position of the enlarged diameter portion in the extension direction of the wire. Additionally, the fixing force between the core crimping portion and the core can be improved in the enlarged diameter portion.

The terminal may be a splice terminal to which plural wires are connected.

The terminal may be a splice terminal for connecting plurality of wires.

The enlarged diameter portions may be provided on both end parts of the core crimping portion in the extension direction.

According to the invention a fixing force between a terminal and at least one wire can be improved.

DETAILED DESCRIPTION

First Embodiment

Figure 1:
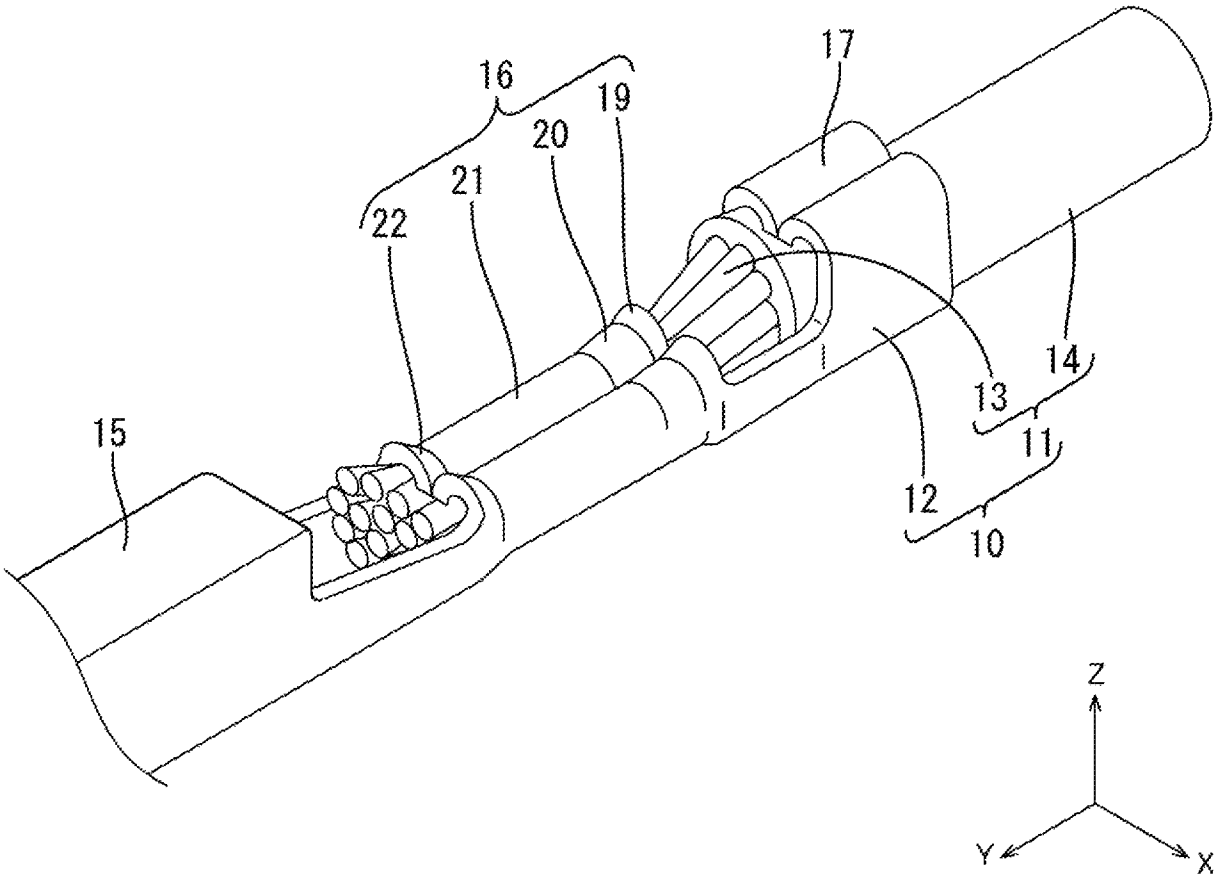
FIG. 1 is a partial enlarged perspective view showing a wire with terminal according to a first embodiment.

A first embodiment is described with reference to FIGS. 1 to 5. A wire with a terminal 10 according to this embodiment has a wire 11 and a female terminal 12 connected to an end of the wire 11. In the following description, a Z direction is an upward direction and a Y direction is a forward direction. Further, a direction penetrating through the plane of the drawing is referred to as a lateral direction. Further, only one of plural identical members may be denoted by a reference sign and the other member(s) may not be denoted by the reference sign.

The wire 11 includes a core 13 formed by spirally twisting thin metal wires, and an insulation coating 14 made of insulating synthetic resin coats the core 13. The insulation coating 14 is stripped at an end part of the wire 11 to expose the core 13. The core 13 is formed of metal, such as aluminum, aluminum alloy, copper or copper alloy. The core 13 of this embodiment is made of aluminum or aluminum alloy.

The terminal 12 is manufactured by punching and bending a metal plate material. A plate made of copper or copper alloy and having tin plating applied to a surface can be used, for example, as the metal plate material for the terminal 12.

Figure 2:
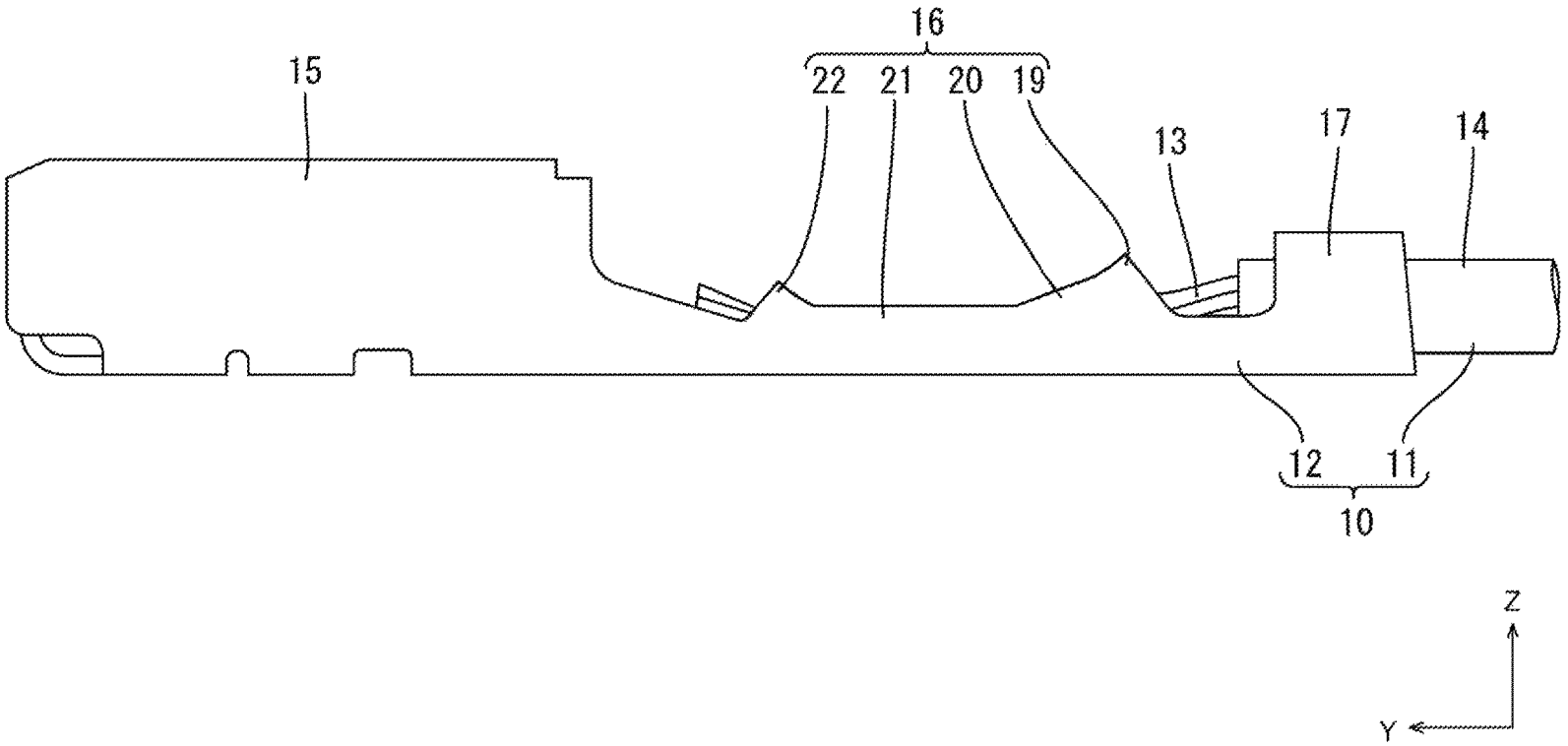
FIG. 2 is a side view showing the wire with terminal.

As shown in FIG. 2, the terminal 12 includes a terminal body 15, a wire barrel 16 (an example of a core crimping portion) connected behind the terminal body 15 and an insulation barrel 17 connected behind the wire barrel 16. The terminal body 15 is a tube open forward and rearward and can establish conductive connection by receiving a mating male terminal (not shown) therein from the front. The wire barrel 16 is fixed to the core 13 exposed at the end of the wire 11. The insulation barrel 17 is fixed to wind around the outer periphery of the insulation coating 14 at the end part of the wire 11.

The wire barrel 16 is shaped to extend in a lateral direction and is caulked and crimped to the core 13. The crimped wire barrel 16 winds around the outer periphery of the core 13 and applies a predetermined compressive force to the crimped core 13.

The wire barrel 16 includes a rear spreading portion 19, an enlarged diameter portion 20, a parallel portion 21 and a front spreading portion 22 in this order from the rear in an extension direction of the wire 11 (direction indicated by an arrow A, front-rear direction in this embodiment). Note that the extension direction is an extending direction of the wire 11 connected to the wire barrel 16.

The rear spreading portion 19 is formed to spread up and laterally toward a rear part of the wire barrel 16. The rear spreading portion 19 is formed by the spreading of the wire barrel 16 to protrude rearward from a rear end part of an anvil (not shown).

The enlarged diameter portion 20 is formed to spread in the upward and lateral directions toward the rear end part of the wire barrel 16 (toward the rear). The enlarged diameter portion 20 is formed by an inclined surface 28 formed on a rear part of the anvil and the wire barrel 16 contacting each other.

The parallel portion 21 extends in the front-rear direction when viewed laterally and is formed so that a vertical interval between upper and lower surfaces is substantially equal in the front-rear direction. The parallel portion 21 is the longest part of the wire barrel 16 in the front-rear direction.

The front spreading portion 22 spreads up and laterally toward a front end of the wire barrel 16. The front spreading portion 22 is formed by the spreading of the wire barrel 16 to protrude forward from a front part of the anvil.

Figure 3:
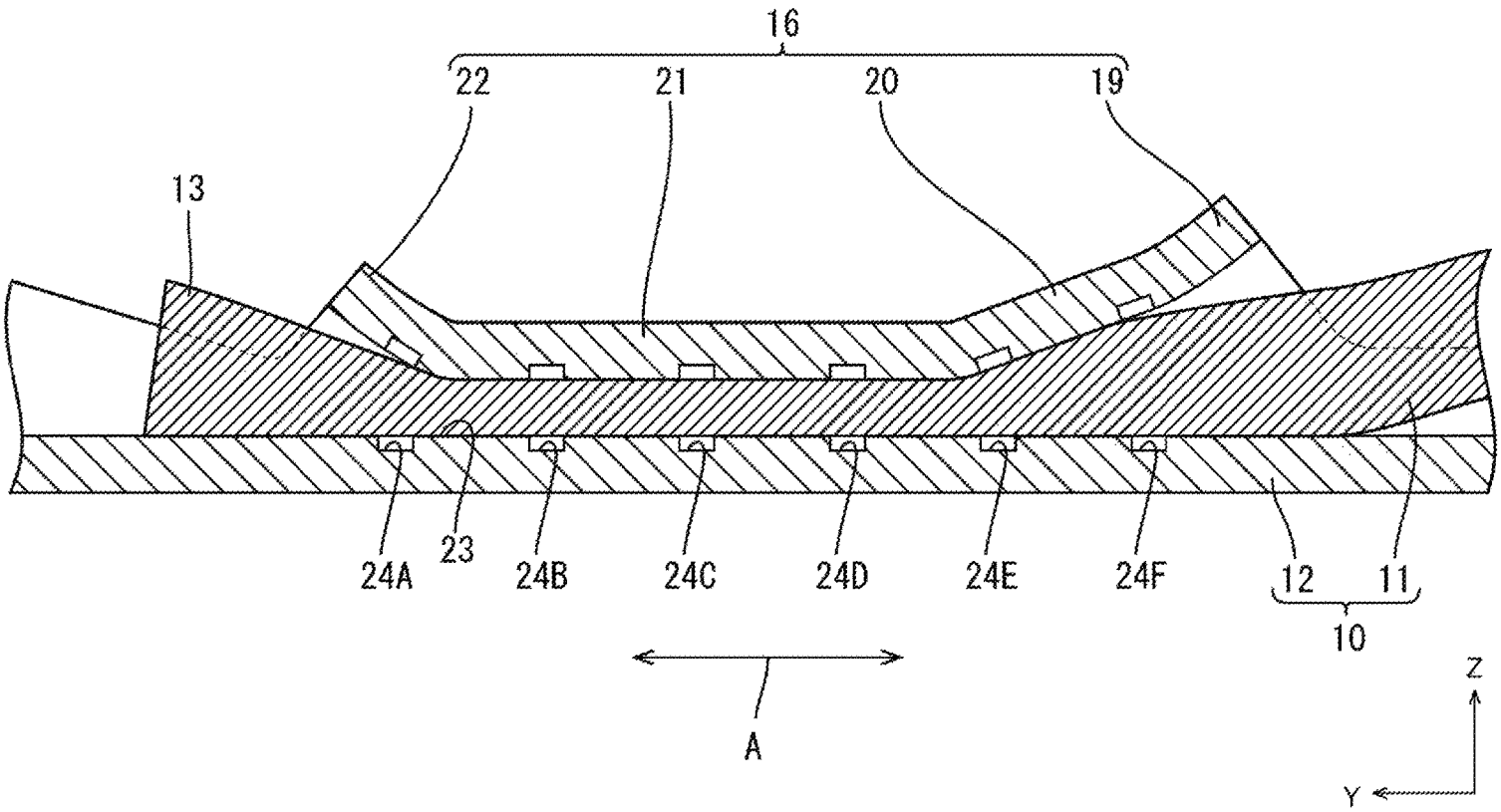
FIG. 3 is a partial enlarged section showing the wire with terminal.

The wire barrel 16 has a placing surface 23 on which the core 13 is arranged. The placing surface 23 contacts the outer periphery of the core with the wire barrel 16 crimped to the core. As shown in FIG. 3, recesses 24A, 24B, 24C, 24D, 24E and 24F are formed at predetermined intervals in the placing surface 23 of the wire barrel 16. Although not shown in detail, the recesses 24A to 24F are long and narrow in a circumferential direction of the core 13 with the wire barrel 16 crimped to the core 13. Note that, in FIG. 3, parts of the core 13 having entered the recesses 24A to 24F are not shown clearly so that the recesses 24A to 24F can be seen.

As shown in FIG. 3, one recess 24A is formed in the placing surface 23 of the front spreading portion 22. The core 13 is not in contact with an upper side of the placing surface 23 of the front spreading portion 22 in FIG. 3 and is not inserted into the recess 24A formed in the front spreading portion 22.

Figure 5:
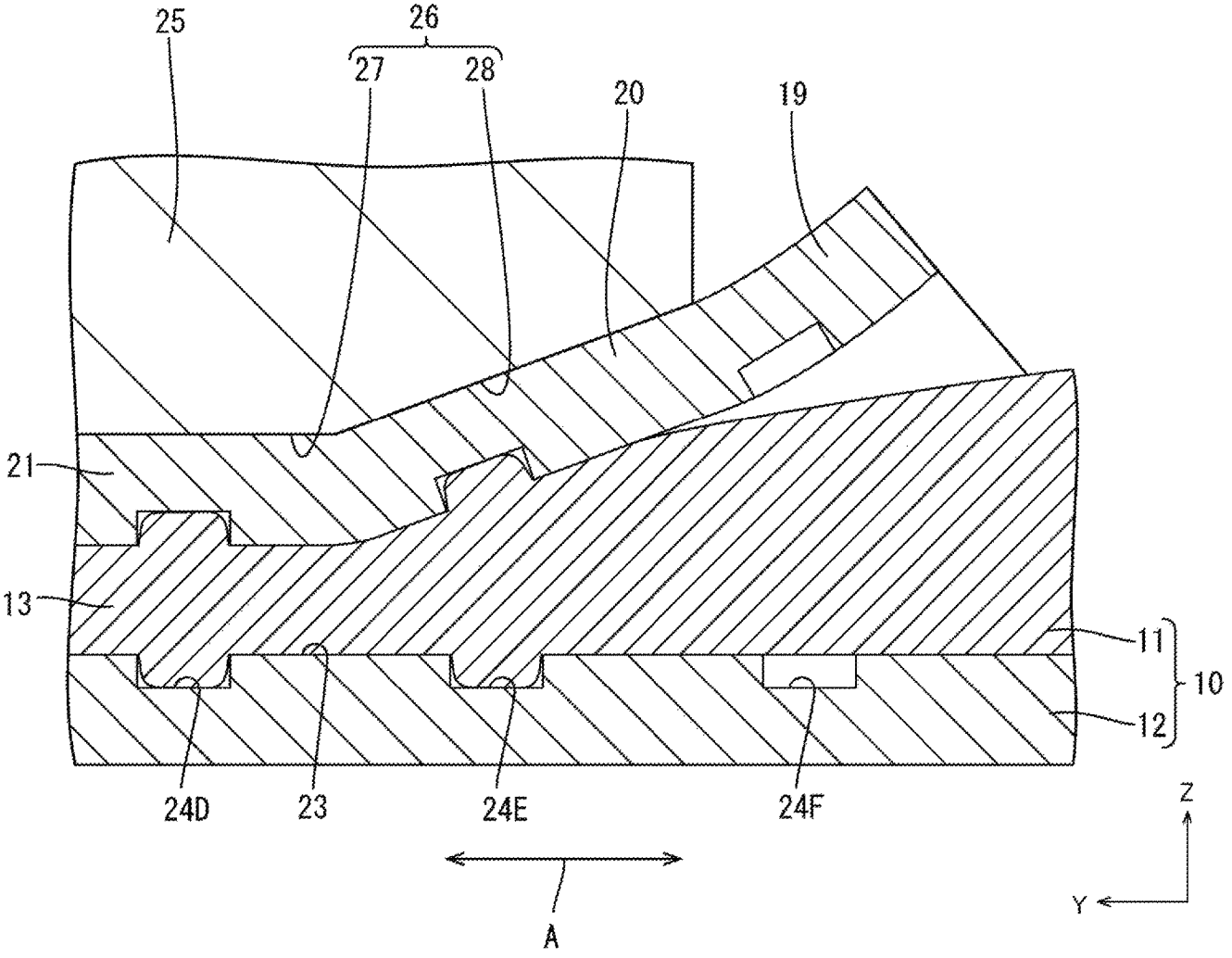
FIG. 5 is a partial enlarged section showing a state where an enlarged diameter portion is formed by the crimper.

Three recesses 24B, 24C and 24D are formed in the parallel portion 21. The core 13 is in contact with the placing surface 23 of the parallel portion 21 over the entire periphery of the core 13. Thus, as shown in FIG. 5, the core 13 enters the recesses 24B, 24C and 24D formed in the placing surface 23 of the parallel portion 21. In this way, an oxide film formed on the outer periphery of the core 13 is peeled off by sliding in contact with edges formed on edges of the recesses 24B, 24C and 24D, and the exposed metal and the wire barrel 16 are connected electrically. Since no oxide film is formed on the exposed metal, electrical connection reliability between the wire barrel 16 and the core 13 is improved. As just described, the core 13 and the terminal 12 can be connected electrically in the parallel portion 21.

One recess 24E is disposed in the facing placing surface 23 in the enlarged diameter portion 20. The core 13 is in contact with the placing surface 23 of the enlarged diameter portion 20 over the entire periphery of the core 13. Thus, as shown in FIG. 5, the core 13 enters the recess 24E formed in the placing surface 23 of the enlarged diameter portion 20. In this way, the core 13 urged into the recess 24E is anchored to improve a fixing force between the core 13 and the wire barrel 16.

One recess 24F is formed in the rear spreading portion 19. The core 13 is not in contact with an upper side of the placing surface 23 of the rear spreading portion 19 in FIG. 3. Thus, the core 13 does not enter the recess 24F in the rear spreading portion 19.

Figure 4:
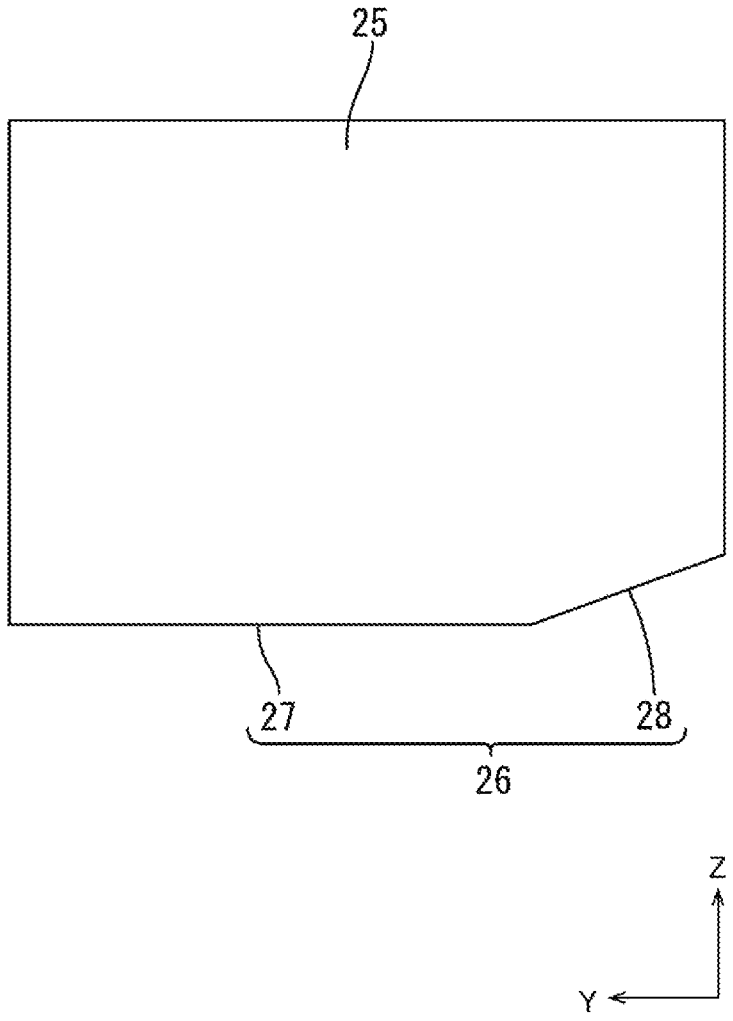
FIG. 4 is a side view showing a crimper.

The above-described wire barrel 16 is crimped to the core 13 using a crimper 25 configured as shown in FIG. 4. The crimper 25 is made of metal and vertically faces the unillustrated anvil on which the terminal 12 is placed so that the wire barrel 16 is sandwiched and compressed between the anvil and the crimper 25 to deform and crimp the wire barrel 16 to the core 13. The crimper 25 has a contact surface 26 configured to contact the wire barrel 16 of the terminal 12. The contact surface 26 of the crimper 25 includes a parallel surface 27 extending along the front-rear direction and the inclined surface 28 connected behind the parallel surface 27 (on a draw-out side of the wire 11). The wire barrel 16 is shaped so that the contact surface 26 of the crimper 25 is transferred to the wire barrel 16 during crimping. That is, the shapes, formation ranges and inclination angles of the parallel surface 27 and the inclined surface 28 of the contact surface 26 of the crimper 25 are substantially the same as the shapes, formation ranges and inclination angles of the parallel portion 21 and the enlarged diameter portion 20 in the wire barrel 16 already described.

The core 13 having the wire barrel 61 crimped thereto is not in contact with the entire area of the enlarged diameter portion 20 and not in contact with the placing surface 23 of the enlarged diameter portion 20 on a side behind a certain position on the draw-out side of the wire 11, as shown in FIG. 5.

The wire with terminal 10 according to this embodiment is structured as described above. Next, an example of the manufacturing process of the wire with the terminal 10 is described.

The manufacturing process includes a core arranging step that includes placing the terminal 12 on the anvil, setting the exposed core 13 at the end part of the wire 11 on the wire barrel 16 of the terminal 12 and setting the end part of the insulation coating 14 of the wire 11 on the insulation barrel 17 of the terminal 12.

The manufacturing process then includes a crimping step that uses the crimper 25 for deforming, caulking or crimping the wire barrel 16 to the core 13. The contact surface 26 of the crimper 25 contacts the wire barrel 16 in the crimping step and is composed of the parallel surface 27 and the inclined surface 28 extending rearward from the parallel surface 27 (on the draw-out side of the wire 11). The inclined surface 28 slopes up with distance from the parallel surface 27, as shown in FIG. 5. The shape of the contact surface 26 of the crimper 25 is transferred to the caulked wire barrel 16. Thus, the wire barrel 16 includes the parallel portion 21 and the enlarged diameter portion 20 that is enlarged in diameter with distance rearward from the parallel portion 21.

As described above, the wire with terminal 10 of this embodiment includes at least one wire 11 having the core 13 and the terminal 12 connected to the wire 11. The terminal 12 includes the wire barrel 16 to be caulked and crimped to the core 13. The enlarged diameter portion 20 is provided on at least a rear end part of the wire barrel 16 and is enlarged in diameter toward the rear end part. At least one recess 24E is provided at a position corresponding to the enlarged diameter portion 20 and in a region configured to contact the core 13 in the placing surface 23 of the wire barrel 16 on which the core 13 is arranged.

According to the above configuration, the wire barrel 16 is crimped to the core 13 in a low compression state in the enlarged diameter portion 20. A fixing force between the wire barrel 16 and the core 13 is relatively large in a region where the core 13 is in the low compression state. The core 13 enters the recess 24E in this low compression region and is anchored in the recess 24E to improve the fixing force between the wire barrel 16 of the terminal 12 and the core 13. As a result, a fixing force between the terminal 12 and the wire 11 can be improved.

Second Embodiment

Figure 6:
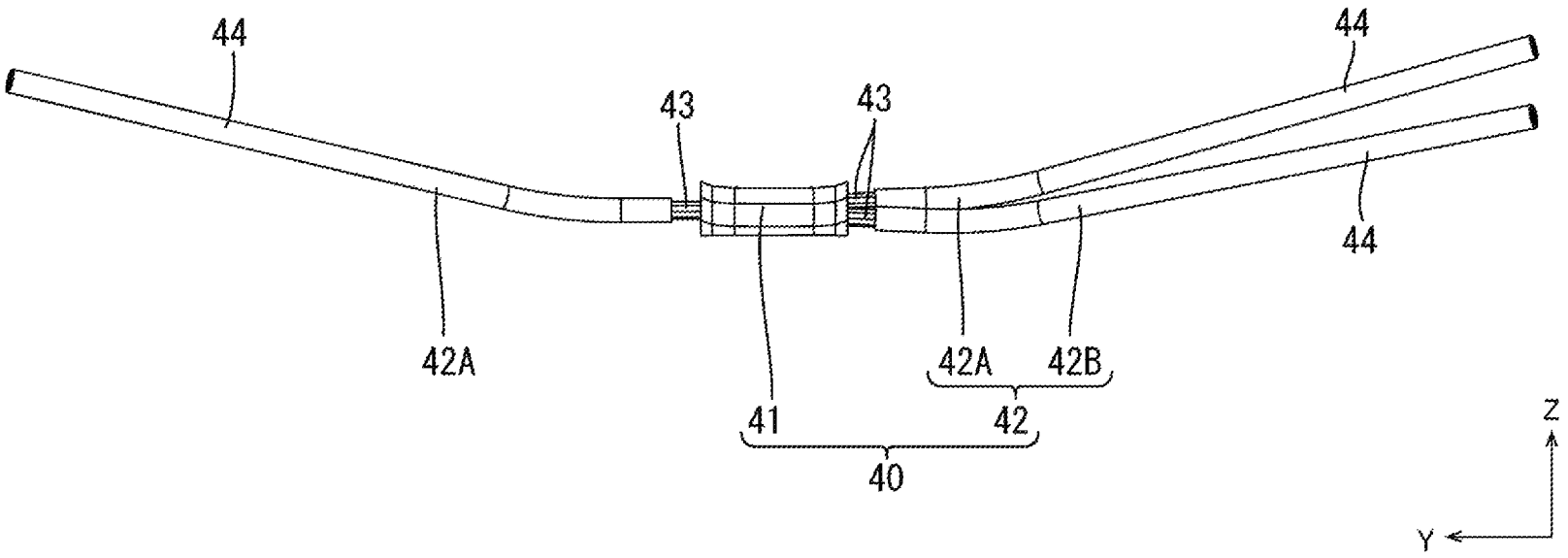
FIG. 6 is a side view showing a wire with terminal according to a second embodiment.

A second embodiment is described with reference to FIGS. 6 to 15. As shown in FIG. 6, a wire with terminal 40 according to this embodiment is configured such that two wires 42 (main wire 42A and branch wire 42B) are connected using a splice terminal 41. In the following description, a Z direction is an upward direction, a Y direction is a forward direction and an X direction is a lateral direction.

The main wire 42A includes a core 43 and an insulation coating 44 made of insulating synthetic resin coats the core 43. The core 43 is formed by twisting thin wires made of metal, such as aluminum, aluminum alloy, copper or copper alloy. In this embodiment, the core 43 is made of aluminum or aluminum alloy. The insulation coating 44 is stripped to expose the core 43 in a part where it is desired to connect the branch wire 42B, as shown in FIG. 6.

Similar to the main wire 42A, the branch wire 42B includes a core 43 and an insulation coating 44. The core 43 of the branch wire 42B also is made of metal, such as aluminum, aluminum alloy, copper or copper alloy, similar to the main wire 42A. In this embodiment, the core 43 of the branch wire 42B is made of aluminum or aluminum alloy. The insulation coating 44 is stripped to expose the core 43 in an end part of the branch wire 42B, as shown in FIG. 6.

The core 43 of the main wire 42A and the core 43 of the branch wire 42B are connected electrically by crimping the splice terminal 41 thereto, as shown in FIG. 6.

Figure 7:
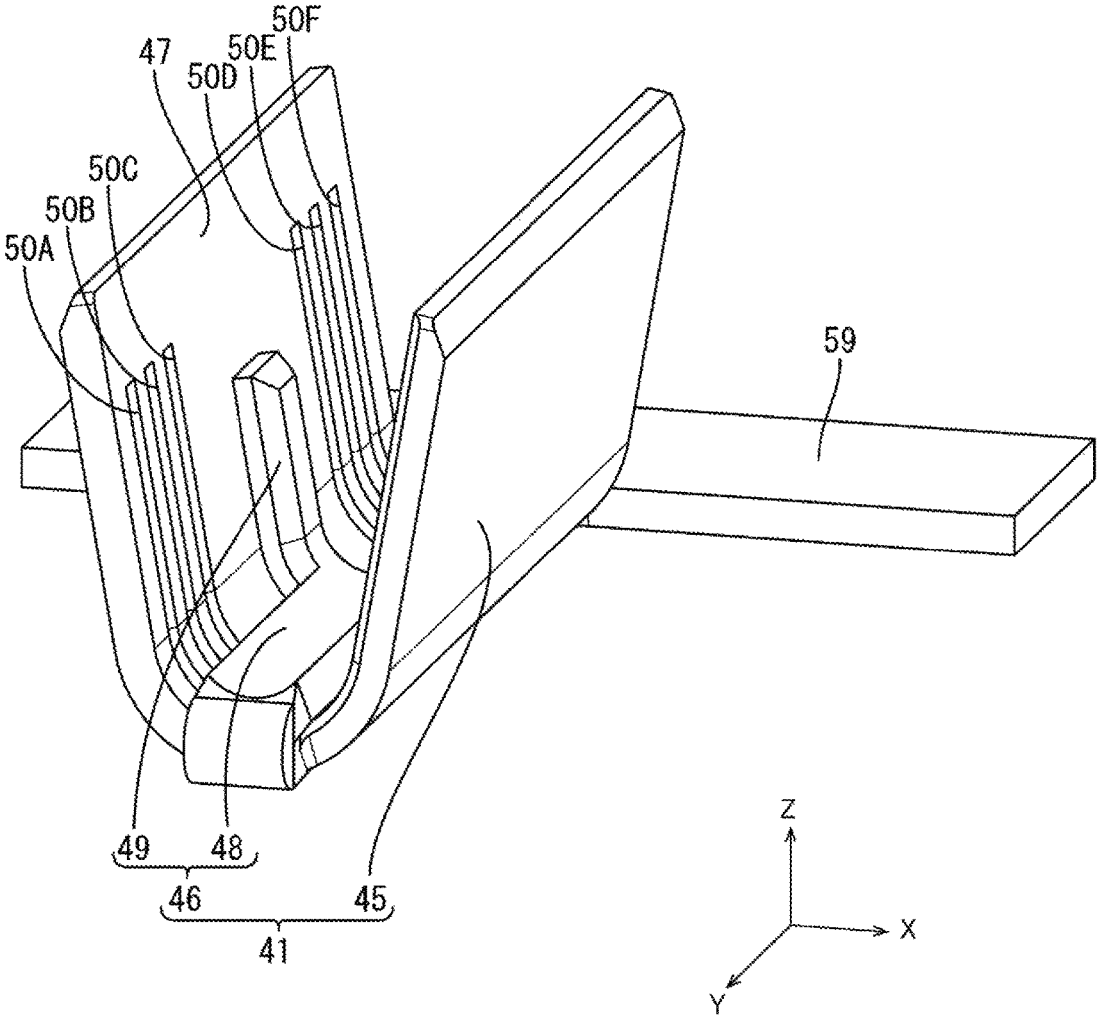
FIG. 7 is a perspective view showing a splice terminal connected to a carrier.

As shown in FIG. 7, the splice terminal 41 is formed of a plate material made of copper or copper alloy, and tin plating is applied to a surface thereof. As shown in FIG. 7, this splice terminal 41 includes a wire barrel 45 (the core crimping portion) having grooves and an extending portion 46 extending from the wire barrel 45.

Before being crimped to the cores 43, the wire barrel 45 is a rectangular plate material curved into a U shape, as shown in FIG. 7. The cores 43 are placed on a part equivalent to a bottom part of the U shape when a crimping operation is performed. An inner side surface of the wire barrel 45 serves as a placing surface 47 configured to contact the cores 43 when the splice terminal 41 is crimped to the cores 43.

As shown in FIG. 7, the extending portion 46 extends forward from a front part of the wire barrel 45 and is folded rearward. The extending portion 46 includes a coupling 48 extending in a front-rear direction and a compressing portion 49 on the tip of the coupling 48. When viewed from above, the extending portion 46 is substantially T-shaped (see FIG. 13). In a state where the extending portion 46 is folded rearward and disposed on the placing surface 47 of the wire barrel 45, the compressing portion 49 is substantially at a center of the wire barrel 45 in the front-rear direction.

Figure 8:
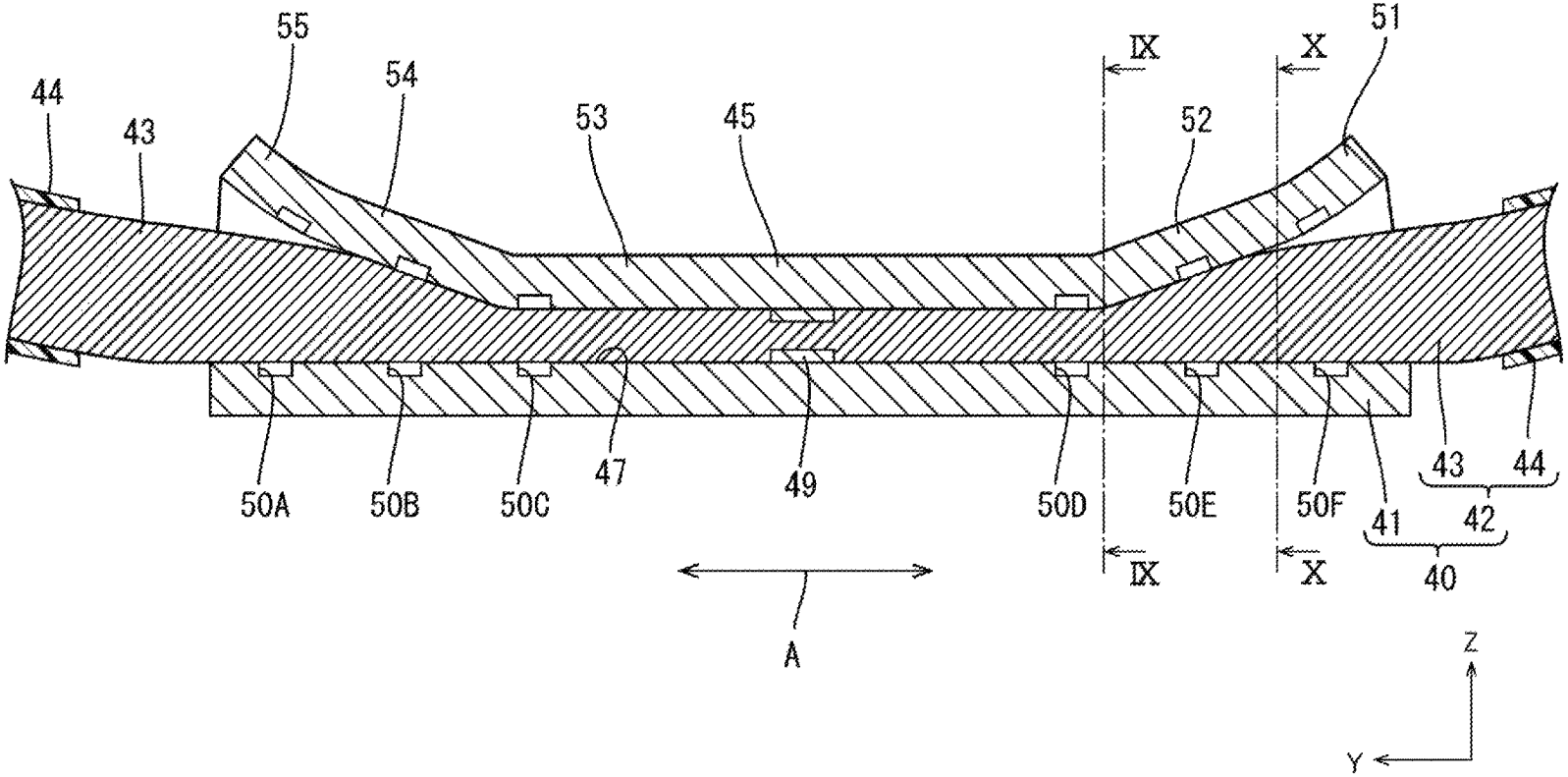
FIG. 8 is a partial enlarged section showing the wire with terminal.

As shown in FIG. 8, recesses 50A, 50B, 50C, 50D, 50E and 50F are formed side by side at intervals in the front-rear direction in the placing surface 47 of the wire barrel 45. The recesses 50A to 50F are long and narrow grooves extending along the placing surface 47 of the U-curved wire barrel 45. In a state where the extending portion 46 is folded on the placing surface 47 of wire barrel 45, three recesses 50A, 50B and 50C are formed before the compressing portion 49, three recesses 50D, 50E and 50F are formed behind the compressing portion 49, and none of the recesses 50A to 50F are at a position corresponding to the compressing portion 49.

With the splice terminal 41 crimped to the cores 43, the wire barrel 45 holds the cores 43 by being wound around the outer peripheries of the core 43 of the main wire 42A and the core 43 of the branch wire 42B.

Figure 10:
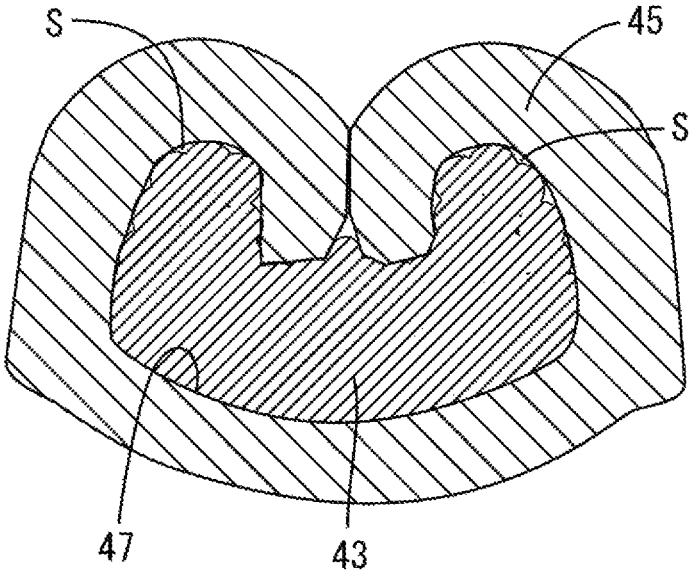
FIG. 10 is a section along IX-IX in FIG. 8.

As shown in FIGS. 7 and 10, the tips of the wire barrel 45 are curved toward each other and are bent down to butt against each other and to bite into the cores 43 from above with the wire barrel 45 crimped to the cores 43.

As shown in FIG. 8, the wire barrel 45 includes a rear spreading portion 51, a rear enlarged diameter portion 52, a parallel portion 53, a front enlarged diameter portion 54 and a front spreading portion 55 in this order from the rear in a state crimped to the cores 43. Recesses 50A to 50F are formed side by side at predetermined intervals in the placing surface 47 of the wire barrel 45. The recesses 50A to 50F are long and narrow in a circumferential direction of the cores 43 with the wire barrel 45 crimped to the cores 43. Note that FIG. 8 does not show parts of the cores 43 in the recesses 50A to 50F so that the recesses 50A to 50F can be shown more clearly.

The rear spreading portion 51 spreads up and laterally toward a rear end part of the wire barrel 45. The rear spreading portion 51 is formed by the spreading of the wire barrel 45 to protrude rearward from a rear part of an anvil. One recess 50F is provided in the placing surface 47 of the rear spreading portion 51. The cores 43 are not inserted into the recess 50F disposed in the rear spreading portion 51.

The rear enlarged diameter portion 52 spreads up and laterally toward the rear end of the wire barrel 45. The rear enlarged diameter portion 52 is formed by a rear inclined surface 65 formed on a rear end part of the anvil and the wire barrel 45 contacting each other. One recess 50E is provided in the placing surface 47 of the rear enlarged diameter portion 52. The cores 43 are urged into the recess 50E in the rear enlarged diameter portion 52.

The parallel portion 53 extends in the front-rear direction when viewed laterally. The parallel portion 53 is formed such that a vertical interval between upper and lower surfaces is substantially equal in the front-rear direction. The parallel portion 53 is longer in the front-rear direction than other parts of the wire barrel 45. Two recesses 50C, 50D are provided in the placing surface 47 of the parallel portion 53, and the cores 43 are urged into the recesses 50C, 50D in the parallel portion 53.

The front enlarged diameter portion 54 is spread up and laterally toward a front end of the wire barrel 45. The front enlarged diameter portion 54 is formed by contact between the wire barrel 45 and a front inclined surface 66 on a front part of the anvil. One recess 50B is provided in the placing surface 47 of the front enlarged diameter portion 54, and the cores 43 are urged into the recess 50B in the front enlarged diameter portion 54.

The front spreading portion 55 is spread up and laterally toward the front end of the wire barrel 45. The front spreading portion 55 is formed by the spreading of the wire barrel 45 to protrude forward from a front end of the anvil. One recess 50A is provided in the placing surface 47 of the front spreading portion 55, and the cores 43 are urged into the recess 50A in the front spreading portion 55.

The cores 43 are compressed by the wire barrel 45 being caulked to wind around the cores 43 in a region where the placing surface 47 of the wire barrel 45 is in contact with the cores 43. A compressed state of the cores 43 is described.

The cores 43 are compressed most in a region of the parallel portion 53 where the compressing portion 49 is disposed. This is because the cores 43 are compressed in a region narrower than a region surrounded by the placing surface 47 of the wire barrel 45 by disposing the coupling portion 49.

The cores 43 are compressed to a second most amount in a region of the parallel portion 53 before the compressing portion 49. This is because the cores 43 are compressed in a region narrower than the region surrounded by the placing surface 47 of the wire barrel 45 and wider than a region where the compressing portion 49 is disposed since the coupling portion 48 is disposed in this region.

The cores 43 are compressed to a third most amount in a region of the parallel portion 53 behind the compressing portion 49. This is because the cores 43 are compressed in the region surrounded by the placing surface 47 of the wire barrel 45 and wider than a region where the coupling portion 48 and compressing portion 49 are disposed.

In the front enlarged diameter portion 54 and the rear enlarged diameter portion 52, the cores 43 are compressed less than in the parallel portion 53. This is because the cores 43 are compressed in a region wider than that in the parallel portion 53 since the front enlarged diameter portion 54 is enlarged in diameter toward the front and the rear enlarged diameter portion 53 is enlarged in diameter toward the rear. Further, the cores 43 are not in contact with the placing surface 47 of the front enlarged diameter portion 54 in a region of the front enlarged diameter portion 54 before a specific position, and the cores 43 are not in contact with the placing surface 47 of the rear enlarged diameter portion 52 in a region of the rear enlarged diameter portion 52 behind a specific position.

The cores 43 are not in contact with the placing surface 47 along the rear and front spreading portions 51 and 55. Thus, the cores 43 are least compressed in the rear and front spreading portions 51 and 55.

The cores 43 are compressed highly in the region of the parallel portion 53 where the compressing portion 49 is disposed and the region of the parallel portion 53 before the compressing portion 49. This high compression is due to the presence of the compressing portion 49 or the coupling portion 48 inside the terminal body 15. In this way, the oxide films formed on the surfaces of the cores 43 are broken to expose the metal inside the oxide films. Contact resistance between the cores 43 and the splice terminal 41 can be reduced by the contact of this metal and the splice terminal 41.

Further, the cores 43 are compressed less in the front and front enlarged diameter portions 52 and 54 because the compressing portion 49 and the coupling portion 48 are not present, thereby preventing breakage of the core 13. As a result, a fixing force between the cores 43 and the splice terminal 41 can be improved.

A compression ratio of the cores 43 is defined as follows where an extending direction of the cores 43 is an extension direction.

Compression ratio %={(cross-sectional area when the region surrounded by the placing surface of the wire barrel is cut along a plane perpendicular to the extension direction)/(cross-sectional area of the core before the core crimping portion is crimped)}×100

According to this definition of the compression ratio, a numerator "cross-sectional area when the region surrounded by the placing surface of the wire barrel is cut along a plane perpendicular to the extension direction" may be larger than a denominator "cross-sectional area of the core before the core crimping portion is crimped". Thus, for example, a case where the wire barrel 45 is deformed plastically to wind around the cores 43 to such an extent that clearances S are formed between the placing surface 47 of the wire barrel 45 and the cores 43, as shown in FIG. 10. In such a case, the compression ratio can be a value larger than 100%.

Figure 9:
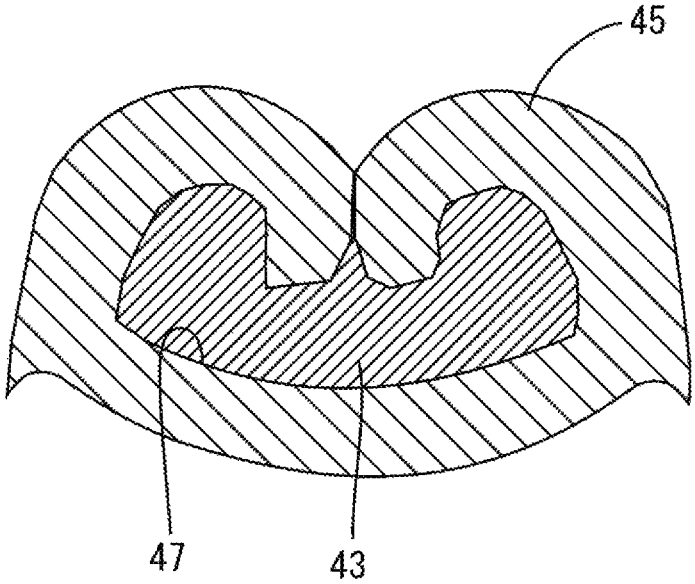
FIG. 9 is a section along VIII-VIII in FIG. 8.

As shown in FIG. 9, in this embodiment, the compression ratio at a front part (innermost position in the extension direction) in the front-rear direction (extension direction in this embodiment) in the rear enlarged diameter portion 52 is preferably equal to or larger than 50% and equal to or smaller than 80% (50% to 80%), more preferably 60% to 70%.

As shown in FIG. 10, in this embodiment, the compression ratio at a rear end part (outermost position in the extension direction) in the front-rear direction (extension direction in this embodiment) in the rear enlarged diameter portion 52 is preferably equal to or larger than 80% and equal to or smaller than 110% (80% to 110%), more preferably 90% to 100%.

An example of a manufacturing method of the splice terminal 41 described above is described below. The manufacturing method for the splice terminal 41 is not limited to the one described below.

Figure 12:
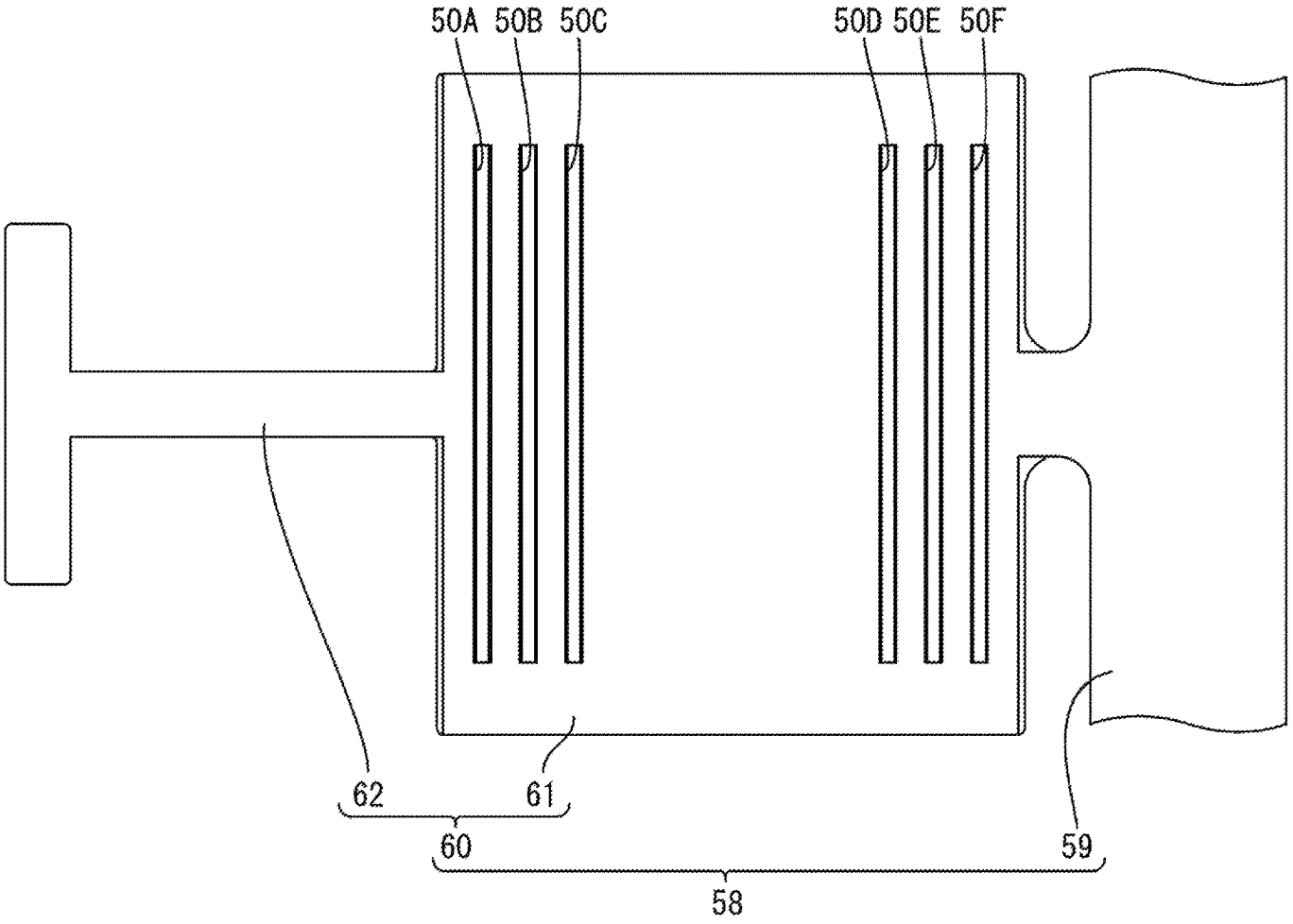
FIG. 12 is a plan view showing a chained terminal.

First, a metal plate material (not shown) is punched and pressed, thereby obtaining chained terminals 58 as shown in FIG. 12. The chained terminals 57 include one strip-like carrier 59 and terminal fragments 60 connected to this carrier 59. The terminal fragment 60 includes a body fragment 61 that will become the wire barrel 45, and an extending fragment 62 that will become the extending portion 46. The terminal fragment 60 is formed with the recesses 50A to 50F by press-working.

Figure 13:
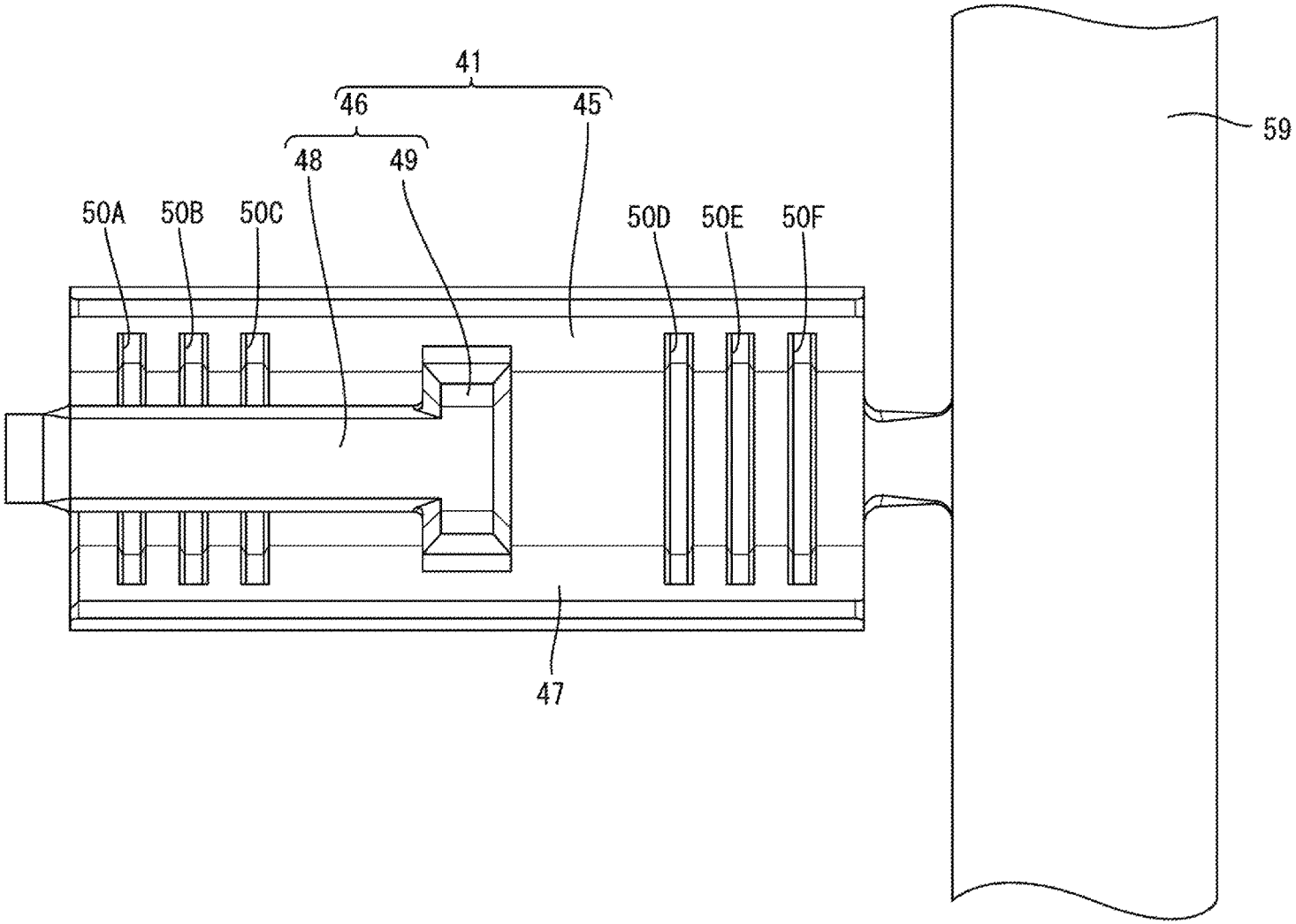
FIG. 13 is a plan view showing a splice terminal connected to a carrier.

Subsequently, the terminal fragments 60 and the extending fragments 62 are bent to obtain the splice terminal 41. Note that the splice terminal 41 is stored while being connected to the carrier 59, as shown in FIG. 13, before being crimped to the cores 43, and is separated from the carrier 59 when being crimped to the cores 43.

An exemplary step of crimping this splice terminal 41 to the cores 43 is described below.

Figure 11:
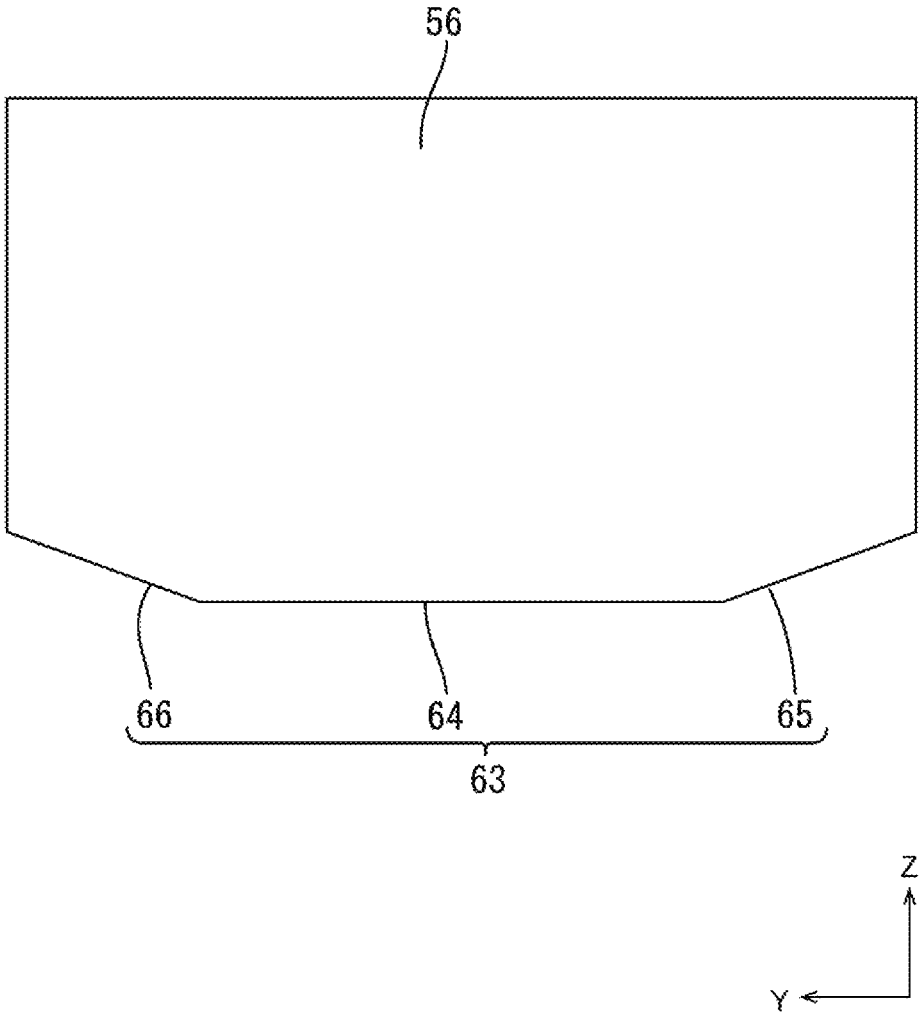
FIG. 11 is a side view showing a crimper.

A crimping tool for crimping the splice terminal 41 to the cores 43 is composed of the anvil and a crimper 56 (see FIG. 11). The anvil is a member on which the splice terminal 41 is placed, and the crimper 56 is a member disposed to face the anvil and is configured to sandwich and curve the wire barrel 45 between the anvil and the crimper 56 to wind the wire barrel 56 around the cores 43.

The anvil is a base made of metal and the upper surface thereof serves as a placing surface on which the splice terminal 41 is placed. The placing surface is a recessed surface extending along a curved shape of a bottom plate.

The crimper 56 is a thick plate-like member arranged above the anvil to face the anvil and is arranged longitudinally (in an orientation to be perpendicular to the placing surface) with respect to the anvil. As shown in FIG. 11, a contact surface 63 of the crimper 56 is configured to contact the wire barrel 45 and is composed of a parallel surface 64 for forming the parallel portion 53, a rear inclined surface 65 connected behind the parallel surface 64 and inclined up with distance from the parallel surface 64 and a front inclined surface 66 connected before the parallel surface 64 and inclined up with distance from the parallel surface 64. The contact surface 26 of the crimper 56 is transferred to the caulked wire barrel 45. That is, the wire barrel 45 includes at least the parallel portion 53, the rear enlarged diameter portion 52 connected behind the parallel portion 53 and enlarged in diameter with distance from the parallel portion 53 and the front enlarged diameter portion 54 connected before the parallel portion 53 and enlarged in diameter with distance from the parallel portion 53.

The cores 43 are arranged on the wire barrel 45 to crimp the splice terminal 41 to the cores 43 using this crimping tool. The splice terminal 41 having the cores 43 arranged thereon then is positioned and arranged on the placing surface of the anvil.

The crimper 56 then is lowered toward the splice terminal 41 so that the contact surface 63 of the crimper 56 contacts the wire barrel 45 and plastically deforms the wire barrel 45. This transfers the shape of the contact surface 63 of the crimper 56 to the wire barrel 45 and thereby crimps the wire barrel 45 of the splice terminal 41 to the cores 43.

As described above, the wire with terminal 40 of this embodiment includes the main wire 42A and the branch wire 42B each having the core 43. The splice terminal 41 is connected to the main wire 42A and the branch wire 42B. The splice terminal 41 includes the wire barrel 45 to be caulked and crimped to the cores 43. The rear enlarged diameter portion 52 is provided on the rear end part of the wire barrel 45 in the extension direction of the main wire 42A and the branch wire 42B and is enlarged in diameter toward the rear. The front enlarged diameter portion 54 is provided on the front part and is enlarged in diameter toward the front. The recess 50B is provided at the position corresponding to the front enlarged diameter portion 54, which is a region configured to contact the cores 43, and the recess 50E is provided at the position corresponding to the rear enlarged diameter portion 52, which is a region configured to contact the cores 43 in the placing surface 47 of the wire barrel 45.

According to the above configuration, the cores 43 are crimped in the low compression state by the wire barrel 45 in the front enlarged diameter portion 54 and the rear enlarged diameter portion 52. The fixing force between the wire barrel 45 and the cores 43 is relatively large in the regions where the cores 43 are in the low compression state. In this low compression state, the cores 43 are inserted into the recesses 50B, 50E. Thus, the cores 43 inserted into the recesses 50B, 50E are anchored to improve the fixing force between the wire barrel 45 of the splice terminal 41 and the cores 43. As a result, the fixing force between the splice terminal 41 and both the main wire 42A and the branch wire 42B can be improved.

Figure 14:
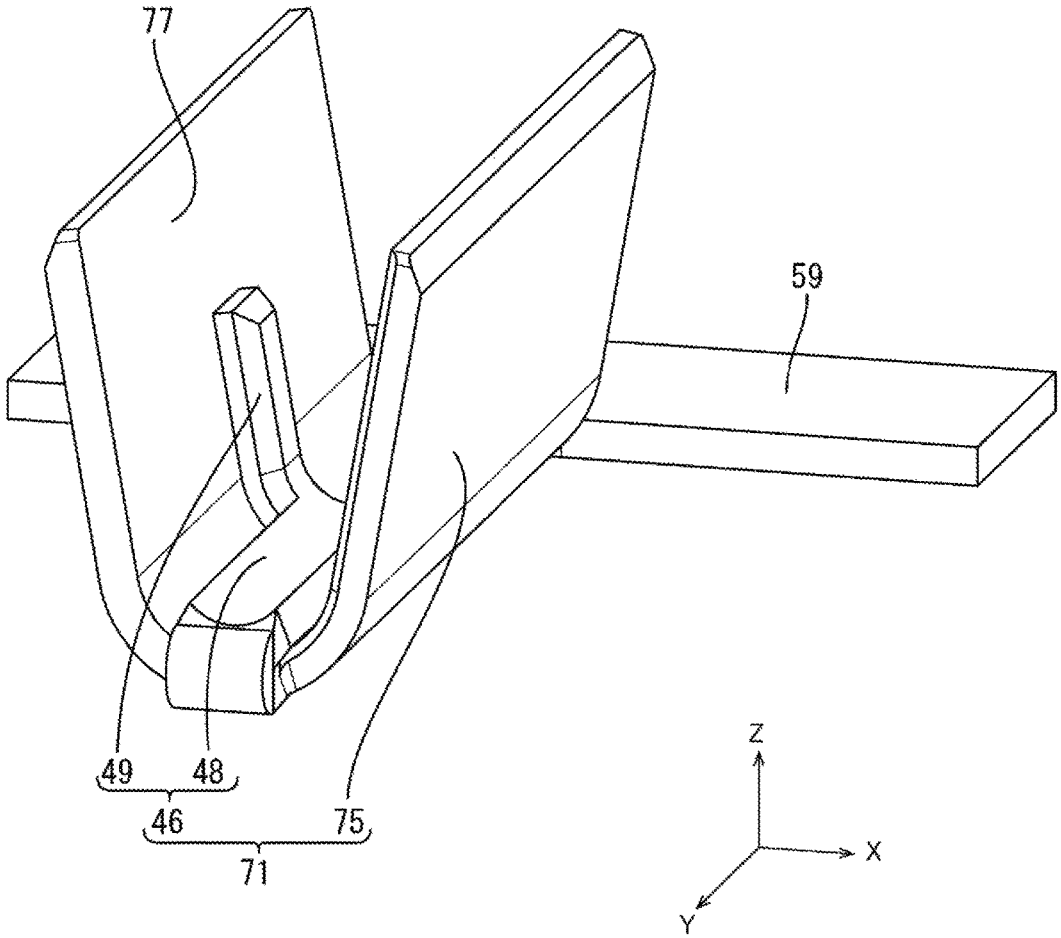
FIG. 14 is a perspective view showing a splice terminal according to a comparative example
Figure 15:
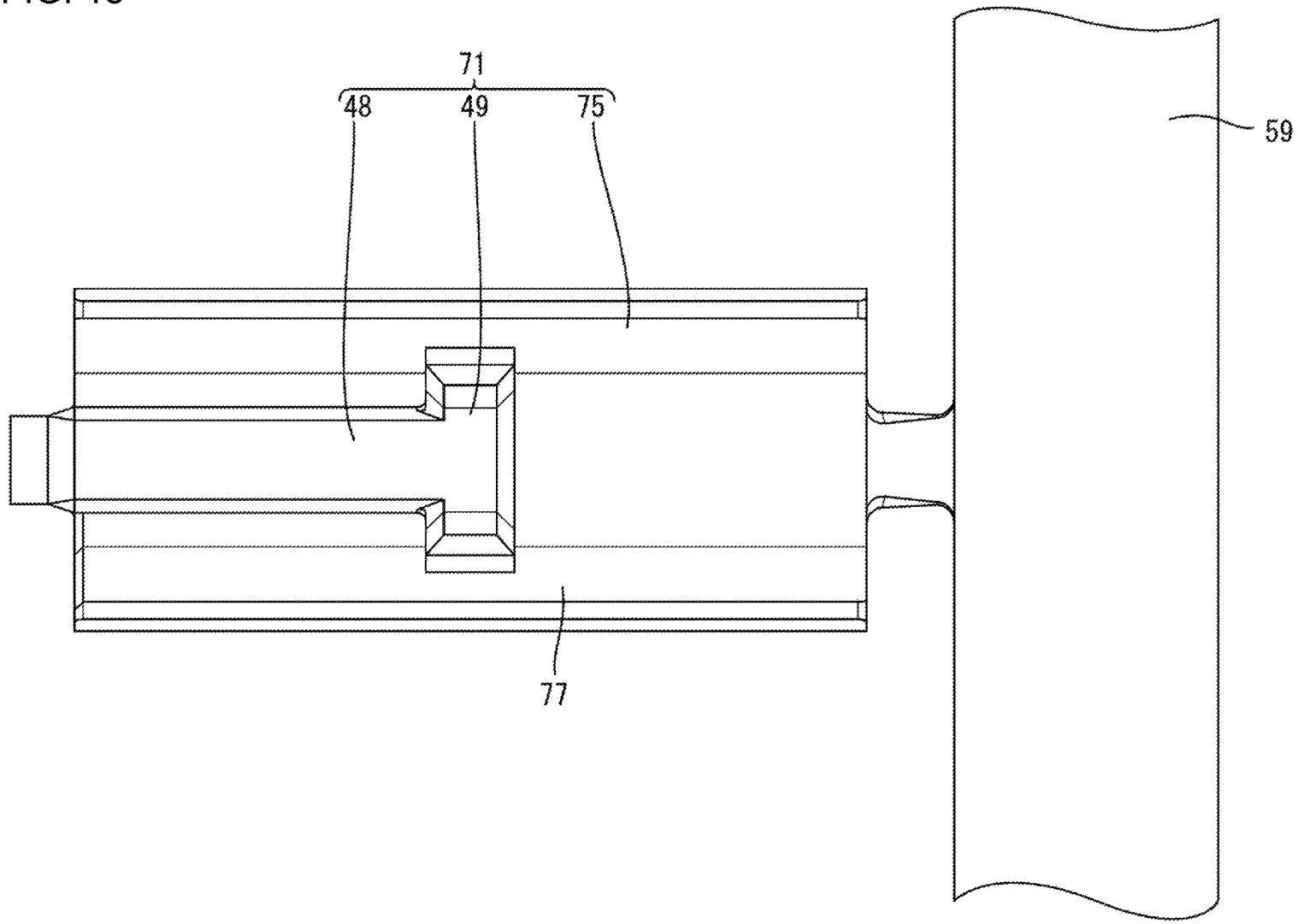
FIG. 15 is a plan view showing the splice terminal according to the comparative example.

FIGS. 14 and 15 provide a comparative example to describe effects of this specification. A splice terminal 71 of the comparative example is similar to the splice terminal 41 of this embodiment except that no recess is provided in a placing surface 77 of a wire barrel 75.

A value of a fixing force between the splice terminal 41 and both the main wire 42A and the branch wire 42B having the splice terminal 41 according to this embodiment crimped thereto is about 1.3 times as large as a value of a fixing force between the splice terminal 71 and both the main wire 42A and the branch wire 42B having the splice terminal 71 according to the comparative example crimped thereto.

Further, according to this embodiment, the above-defined compression ratio at the rearmost (innermost) position of the front enlarged diameter portion 54 in the extension direction is 50% to 80% and the compression ratio at the foremost (outermost) position of the front enlarged diameter portion 54 in the extension direction is 80% to 110%. Further, the compression ratio at the foremost (innermost) position of the rear enlarged diameter portion 52 in the extension direction is 50% to 80% and the compression ratio at the rearmost (outermost) position of the rear enlarged diameter portion 52 in the extension direction is 80% to 110%.

According to the above configuration, electrical connection reliability between the cores 43 and the wire barrel 45 can be improved at the rearmost (innermost) position of the front enlarged diameter portion 54 in the extension direction of the wires 42, and the fixing force between the wire barrel 45 and the cores 43 can be improved in the front enlarged diameter portion 54. Further, electrical connection reliability between the cores 43 and the wire barrel 45 can be improved at the foremost (innermost) position of the rear enlarged diameter portion 52 in the extension direction of the wires 42, and the fixing force between the wire barrel 45 and the cores 43 can be improved in the rear enlarged diameter portion 52.

This specification can be applied to the splice terminal 41 for connecting two wires 42 (main wire 42A and branch wire 42B).

According to this embodiment, the front enlarged diameter portion 54 is provided on the front part of the wire barrel 45 and the rear enlarged diameter portion 52 is provided on the rear part of the wire barrel 45. In this way, the fixing force between the wires 42 and the splice terminal 41 can be improved when the wires 42 are connected by the splice terminal 41.

Figure 16:
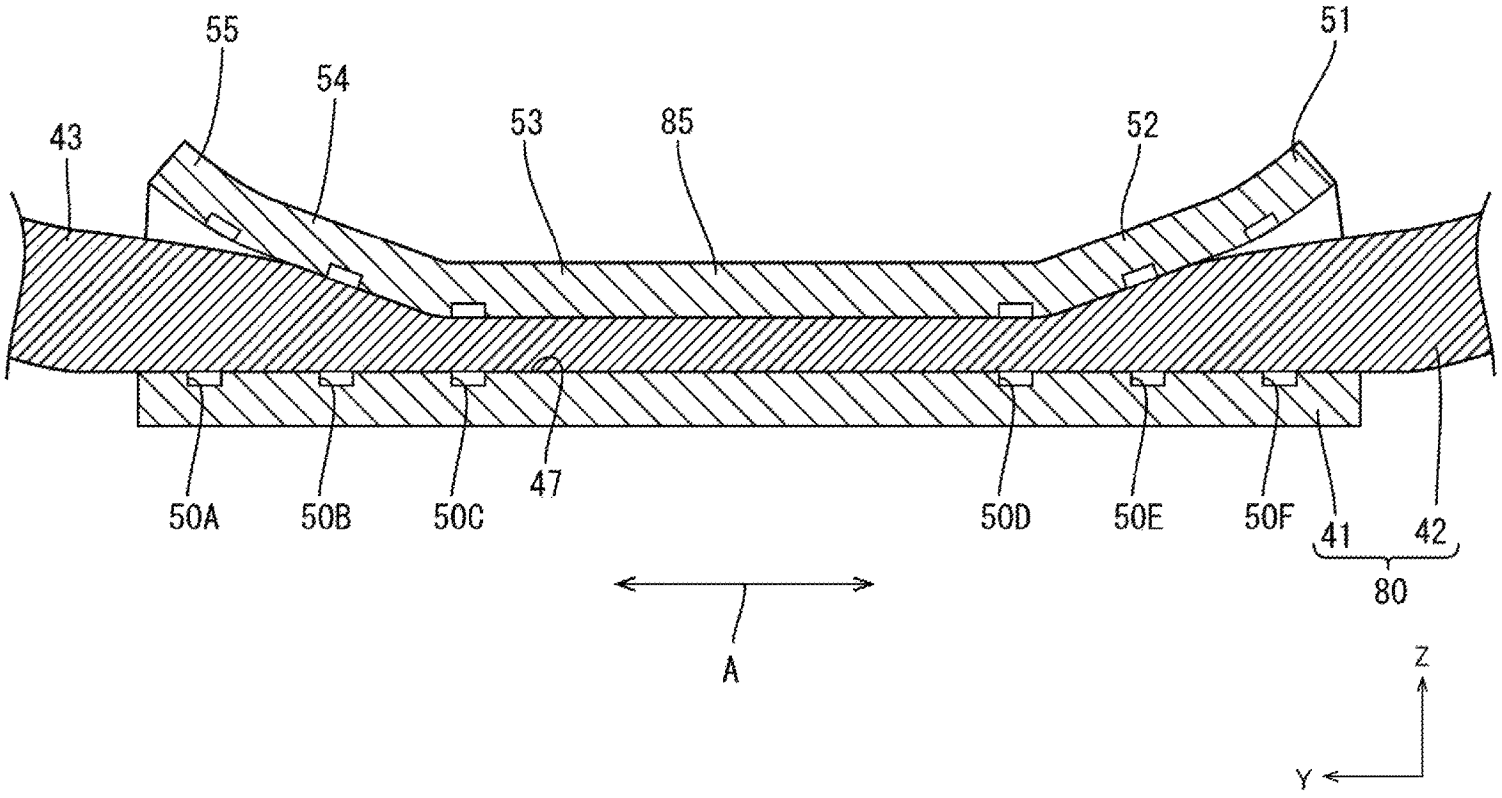
FIG. 16 is a partial enlarged section showing a wire with terminal according to a third embodiment.

Next, a third embodiment is described with reference to FIG. 16. In a splice terminal 80 according to this embodiment, a wire barrel 85 includes no extending portion having a compressing portion and a coupling portion. Since the other configuration is substantially similar to that of the second embodiment, the same members are denoted by the same reference signs and repeated description is omitted.

According to this embodiment, a fixing force between the splice terminal 80 and both the main wire 42A, the branch wire 42B can be improved by a simple configuration.

The invention is not limited to the above described and illustrated embodiments. For example, the following embodiments also are included in the scope of the invention technique described in this specification.

In the wire with terminal according to the first embodiment, enlarged diameter portions may be provided on both ends of the wire barrel in the extension direction.

In the second and third embodiments, an enlarged diameter portion may be provided only on one end part of the wire barrel in the extension direction.

A compression ratio on an innermost part of an enlarged diameter portion may be smaller than 50% or larger than 80%. A compression ratio on an outermost part of the enlarged diameter portion may be smaller than 80% or larger than 110%.

The recesses need not be grooves. For example, the recesses may have polygonal, circular or elliptical shapes and may be discretely provided at intervals.

The wires need not be covered by the insulation coating and may be bare wires.

The splice terminals of the second and third embodiments are configured to connect the main wire and the branch wire, however plural wires may be connected by a terminal.

In the first embodiment, a part to be contacted by the core may be provided on the placing surface of the rear spreading portion and a recess may be formed in a part of the rear spreading portion configured to contact the core. Further, in the second and third embodiments, parts to be contacted by the cores may be provided on the placing surfaces of the front spreading portion and the rear spreading portion and recesses may be formed in parts of the front spreading portion and the rear spreading portion configured to contact the cores.

LIST OF REFERENCE SIGNS

10, 40: wire with terminal
11, 42: wire
12: terminal
13, 43: core
16, 45, 85; wire barrel
20: enlarged diameter portion
23, 47: placing surface
24E: recess
41, 80: splice terminal
42A: main wire
42B: branch wire
48: coupling
50B, 50E: recess
52: rear enlarged diameter portion
54: front enlarged diameter portion

What is claimed is:

1. A wire with terminal, comprising:
at least one wire including a core; and
a terminal connected to the wire;
wherein:
the terminal includes a core crimping portion to be caulked and crimped to the core;
at least one end part of the core crimping portion in an extension direction of the wire is provided with an enlarged diameter portion enlarged in diameter toward the one end part; and
at least one recess is provided at a position corresponding to the enlarged diameter portion and in a region configured to come into contact with the core in a placing surface of the core crimping portion where the core is arranged.

2. The wire with terminal of claim 1, wherein the terminal is a splice terminal to which a plurality of the wires are connected.

3. The wire with terminal of claim 2, wherein the at least one enlarged diameter portion comprises two large diameter portions provided respectively on opposite end parts of the core crimping portion in the extension direction.

4. A wire with terminal, comprising:
at least one wire including a core; and
a terminal connected to the wire, the terminal includes a core crimping portion to be caulked and crimped to the core;
at least one end part of the core crimping portion in an extension direction of the wire is provided with an enlarged diameter portion enlarged in diameter toward the one end part; and
at least one recess is provided at a position corresponding to the enlarged diameter portion and in a region configured to come into contact with the core in a placing surface of the core crimping portion where the core is arranged, wherein:
a compression ratio of the core is defined as a percentage of a cross-sectional area when a region surrounded by the placing surface of the core crimping portion cut along a plane perpendicular to the extension direction to a cross-sectional area of the core before the core crimping portion is crimped,
the compression ratio at an innermost position of the enlarged diameter portion in the extension direction is 50% to 80%; and
the compression ratio at an outermost position of the enlarged diameter portion in the extension direction is 80% to 110%.

5. The wire with terminal of claim 4, wherein the terminal is a splice terminal to which a plurality of the wires are connected.

6. The wire with terminal of claim 5, wherein the at least one enlarged diameter portion comprises two large diameter portions provided respectively on opposite end parts of the core crimping portion in the extension direction.

* * * * *